US005145366A

United States Patent [19]

Janhunen

[11] Patent Number: 5,145,366

[45] Date of Patent: Sep. 8, 1992

[54] RACK FOR INSTRUMENTS

[76] Inventor: Timo Janhunen, Leankuja 4, SF-07230 Monninkylä , Finland

[21] Appl. No.: 775,958

[22] PCT Filed: Apr. 10, 1990

[86] PCT No.: PCT/FI90/00098

§ 371 Date: Oct. 28, 1991

§ 102(e) Date: Oct. 28, 1991

[87] PCT Pub. No.: WO90/13269

PCT Pub. Date: Nov. 15, 1990

[30] Foreign Application Priority Data

May 8, 1989 [FI] Finland ..... 892202

[51] Int. Cl.[5] ..... A61G 15/00

[52] U.S. Cl. ..... 433/77; 433/78; 312/209

[58] Field of Search ..... 433/77, 78, 79; 312/209

[56] References Cited

U.S. PATENT DOCUMENTS 4,421,483 12/1983 Pietschmann et al. ..... 433/77

4,648,839 3/1987 Timerdahl et al. ..... 433/77

FOREIGN PATENT DOCUMENTS 824532 12/1951 Fed. Rep. of Germany .

2489139 3/1982 France ..... 433/77

*Primary Examiner*—John J. Wilson

*Attorney, Agent, or Firm*—Ladas & Parry

[57] ABSTRACT

This invention relates to a rack for instruments, especially dental instruments (1) comprising a drum (2) mounted so as to revolve about a shaft (4), compartments (5) being provided on the periphery of the drum for at least one instrument (1) and its holder (3); an instrument supply line (6) arranged to be connected to one instrument (1) at a time; and a stationary outer casing (7) surrounding the drum (2) and provided with at least one opening for pulling out at least the instrument connected to the supply line. In the invention, to further improve the sterility of the instruments, walls (8) separating the compartments (5) of the drum (2) are sealed (9) relative to the outer casing (7); and the outer casing (7) is provided with means (10, 11, 12) for sterilizing the instruments (1) when they are not being used.

4 Claims, 2 Drawing Sheets

RACK FOR INSTRUMENTS

This invention relates to a rack for instruments, especially for dental instruments, comprising a drum mounted so as to revolve about a shaft, compartments being provided on the periphery of the drum for at least one instrument and its holder;

an instrument supply line arranged to be connected to one instrument at a time; and a stationary outer casing surrounding the drum and provided with at least one opening for pulling out at least the instrument connected to the supply line.

Dental instruments, such as various drills and suction devices for removal of saliva, are conventionally placed in instrument bridges having a holder for each instrument. Such instrument bridges usually provide room for four to seven instruments, and are therefore relatively broad since the instrument holders are positioned side by side. So the instrument bridge is clumsy, especially as a tray is usually attached to it. If the tray is fitted at the side of the instrument bridge, it will be positioned too far to allow easy use. On the other hand, it is also problematic to position the tray beneath the instrument bridge because the instruments easily damage the objects on the tray, in addition to which the objects on the tray may be contaminated by various impurities falling from the instruments. In practice, it is not either advantageous to position the tray upon the instrument bridge, because the tray thereby has to be positioned relatively high to get the instruments at the most advantageous height. In addition, the supply line thereby has to be led from under the tray to the instruments, so that it easily hangs over the patient, which may hamper the use of the instruments.

The problems described above are at least partly solved by an instrument rack known from SE Patent Specification 442 945. One problem with the instrument rack of this particular patent specification as well as many other conventional instrument racks is, however, that the rack does not substantially protect the instruments. Therefore the instruments are easily contaminated by adjacent used instruments or by a jet of water or air from the patient's mouth when drilling with a turbine drill, for instance. To prevent the spreading of various infectious diseases, such as AIDS, the level of sterility should be as high as possible.

The object of the present invention is to provide a rack for instruments, especially for dental instruments, which avoids the problems associated with the above-mentioned solutions known from the prior art. This is achieved by means of a rack according to the invention, which is characterized in that walls separating the compartments of the drum are sealed relative to the outer casing; and that the outer casing is provided with means for sterilizing the instruments when they are not being used.

As the instruments are fitted in a drum rotatable about a vertical shaft, for instance, the rack is relatively narrow. The required tray can now be easily positioned on either side or even on both sides of the rack without excessively increasing the width of the instrument bridge so that the instruments and the tray are nevertheless easy to use. The instrument supply line is arranged to be connected to one instrument at a time, that is, to the instrument used next in each particular case, which reduces the number of connections required for supplying the instruments as well as the number of magnetic valves, which, being fine-mechanical components, are relatively expensive.

To improve sterility, the drum is surrounded with a stationary outer casing provided with at least one opening for pulling out the instrument to be used in each particular case. If required, the opening can be easily made sufficiently large for two instruments one of which projects toward the patient and the other towards the dental assistant, who can thus easily change a drill bit, for instance. In this way, the instrument drum is for a major part surrounded with a protective casing which prevents the contamination of unused instruments. Essential is, however, that the instruments can be sterilized within the outer casing. For this purpose, walls separating the different compartments of the drum are sealed relative to the outer casing, and the outer casing is provided with means for sterilizing the instruments which are not being used. Such sterilizing means may comprise a source of UV light, a source of sterilizing agents, such as a gas or a liquid, and a vapour sterilizing chamber. In this way the instruments can be sterilized as soon as they are not in use, or the drum with the instruments attached to it can be arranged to make one revolution within the outer casing after each patient, thus subjecting each instrument to a sterilizing treatment in every position of the drum. For instance, UV light may be arranged to influence everywhere in the outer casing whereas the sterilizing agents can be placed in one particular instrument compartment. Correspondingly, each instrument can be arranged to enter the vapour chamber once during one revolution of the drum. In this way, both the instruments and the instrument hoses can be sterilized extremely reliably.

In the following, the rack of the invention will be described in greater detail with reference to the attached drawing, wherein FIG. 1 illustrates, by way of example, one specific embodiment of the rack of the invention in a cross-section along its vertical axis;

Figure 1:
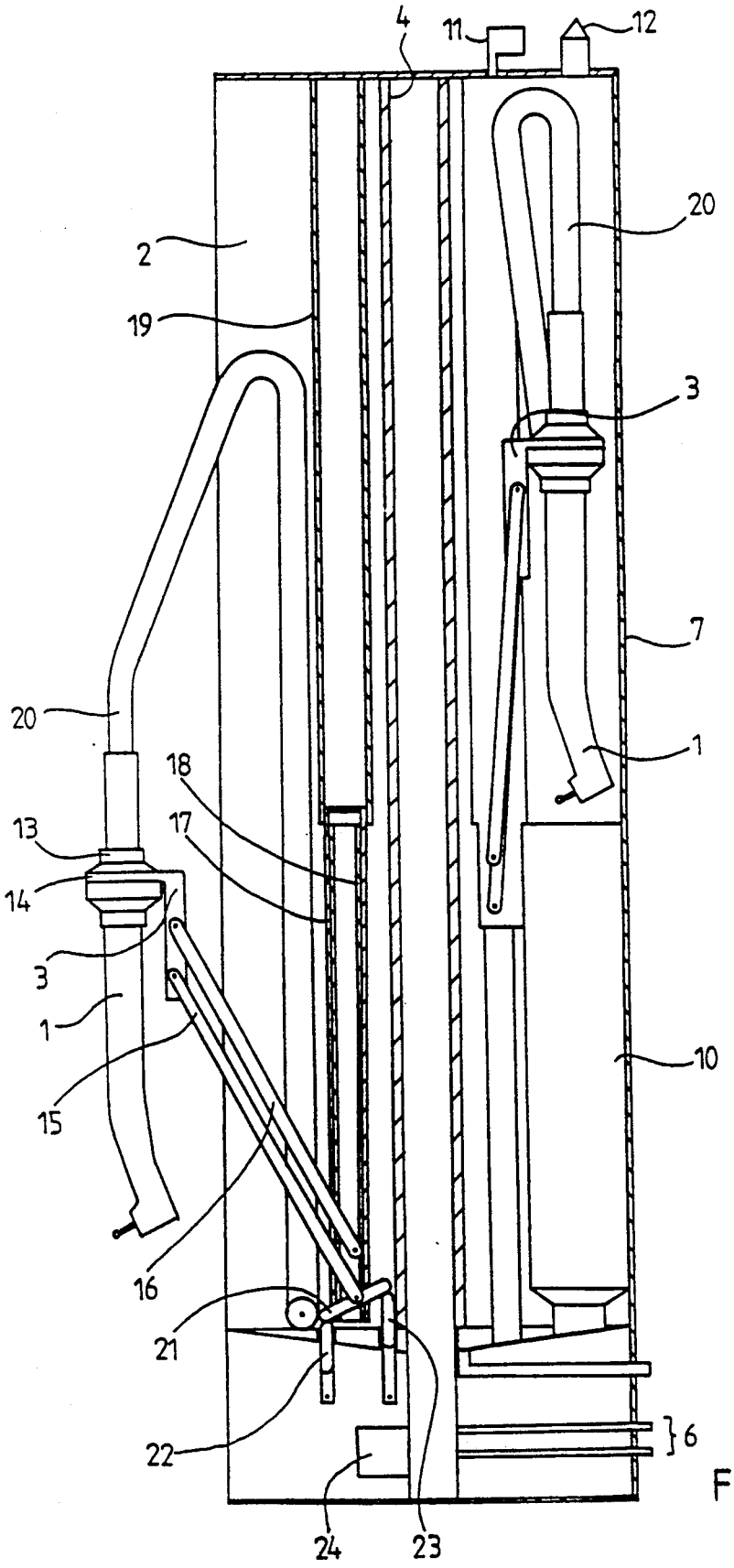
Figure 2:
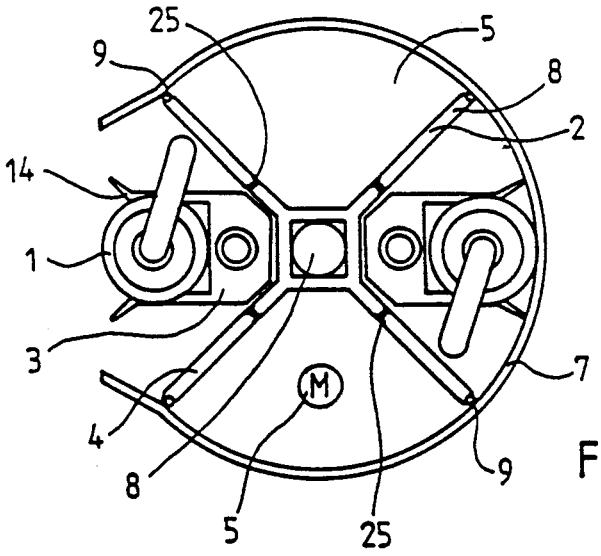
FIG. 2 is a cross-sectional top view of the rack of FIG. 1.

FIGS. 1 and 2 illustrate a specific embodiment of the invention by way of example. This embodiment comprises an instrument drum 2 rotatable about a central shaft 4, preferably but not necessarily a vertical shaft. In this particular embodiment, the instrument drum comprises four instrument compartments 5. In the figures, an instrument 1 is shown in two compartments 5 of the drum 2. The drum 2 is surrounded with a stationary outer casing 7 provided with an opening for pulling out the instrument 1 to be used. As appears from FIG. 1, the instrument 1 rests on a holder 3 comprising a forklike part 14 holding the handle 13 of the instrument 1. Due to the resilience of the branches of the forklike part the handle 13 of the instrument 1 can be pushed within the forklike part. The holder 3 is attached to the middle portion 17 of a three-part lifting/lowering cylinder by means of two articulated arms 15 and 16. The lifting/-lowering cylinder comprises an innermost tubular part 18 which is surrounded by another tubular part 17 the top portion of which is surrounded with still another tubular part 19. When compressed air, for instance, is introduced into the innermost tube 18, the middlemost tube 17 and its holder 3 with instrument 1 is caused to rise to a position in which a supply hose 20 attached to the instrument 1 is close to the top of the outer casing 7. When the innermost tube 18 is unpressurized and the outermost tube 19 is pressurized, the middlemost tube 17 with the instrument attached to it is lowered to a position shown in the left in FIG. 1. The purpose of this lifting/lowering cylinder will be described more closely below. The operation of the articulated arms 15 and 16 attached to the holder 3 is controlled by means of cylinders 22 and 23 acting on a transverse bar 21 attached to the lower end of the articulated arm 15. By means of the cylinders 22 and 23 the position of the articulated arms 15 and 16 may be changed so that the instrument 1 will be withdrawn into the compartment of the instrument drum, so that the drum is able to revolve within the outer casing 7. Before revolving, the instrument in question has to be disconnected from a supply line 6, which is connected to the supply hose 20 of the instrument by a connecting means 24 provided in the stationary bottom portion of the outer casing 7.

As appears from FIG. 2, partition walls between the compartments of the instrument drum 2 are sealed relative to the outer casing 7 by means of seals 9. This ensures that each instrument compartment 5 which has revolved within the outer casing 7 is tightly insulated from the other compartments. As a result, sterilizing liquid or gas can be introduced into any compartment positioned within the outer casing to sterilize the instrument contained in it. For instance, this can take place through a connection shown in FIG. 1. Similarly any compartment can be exposed to UV light from a source 12. The UV light should be switched off when the drum 2 revolves so as to prevent its escape into the surroundings through the opening of the outer casing 7. In the embodiment of the figure, a stationary sterilizing chamber 10 is provided diametrically opposite to the opening of the outer casing 7. In order that the instrument 1 with the hose 20 attached to it could be passed into the sterilizing chamber 10, the instrument first has to be lifted to its upper position by means of the lifting/lowering cylinder. This is because the sterilizing chamber 10 is stationary in position so that is protrudes over a distance from the base of the outer casing 7 into the compartments 5 of the instrument drum 2. For this reason, the partition walls between the compartments have to be provided e.g. with spring-return hinges 25 to enable the revolving of the drum in spite of the sterilizing chamber 10. The hinged portion of the partition walls 8 has to be limited to the lower portion of each wall, corresponding to the sterilizing chamber 10 in height.

Figure 3:
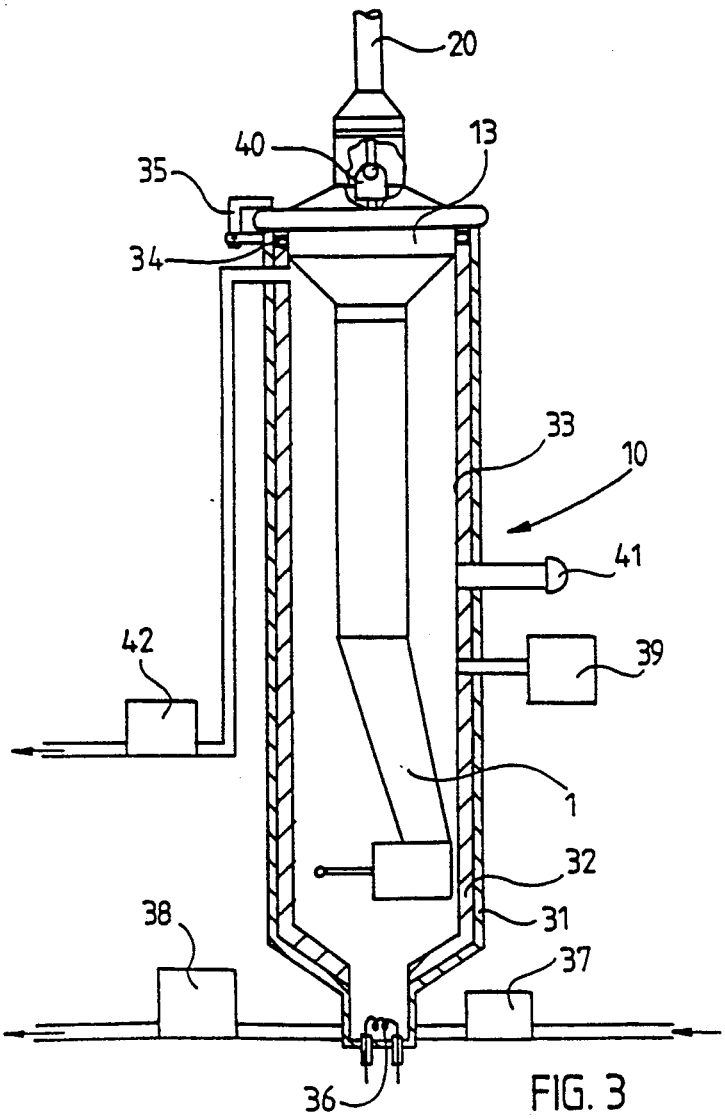
FIG. 3 is a more detailed view of a vapour sterilizing chamber comprised in the rack of the invention shown in FIG. 1.

FIG. 3 shows, by way of example and in more detail, the structure of one specific sterilizing chamber. The chamber 10 comprises a cylindrical outer wall 31 covered with a thermal insulation 32 on the inside. The thermal insulation 32 may be provided with a reflective inner surface 33. When the instrument 1 is passed into the sterilizing chamber 10, its handle 13 is pressed tightly against a seal 34 provided at the top of the sterilizing chamber to prevent the escape of vapour produced in the sterilizing chamber. To ensure that the instrument 1 stays in place, the chamber comprises a latch 35 for locking the instrument in position for the time of the vapour sterilization. A resistor 36 to be heated electrically is provided at the bottom of the chamber to evaporate water supplied by a valve and a pipe 37, for instance, through the bottom end. The water supplied into the chamber can be removed, for instance, through a line provided with a valve 38. The chamber 10 is further connected to a source 41 of UV light and it comprises a pipe connection 42 to change the gas contained in the sterilizing chamber, and a pressure/temperature indicator 39. This instrumentation enables fully controlled vapour sterilization as well as other ways of sterilization. To prevent the escape of vapour from the chamber through the instrument 1 into its supply hose 20, the handle 13 of the instrument 1 is provided with a back valve 40, as shown in the cross-section of FIG. 3. If the sterilizing of all the instruments contained in the rack is considered to be too time-consuming, it is, of course, possible that one rack comprises several such chambers.

The rack of the invention has been described above only by means of one specific embodiment especially suited for dental instruments, particularly for instruments conventionally fitted in an instrument bridge. The appearance of the rack of the invention will be slightly different from that shown in the figures if the rack is used with so-called suction side instruments mainly intended for the removal of saliva from the patient's mouth. The scope of protection of the present invention such as defined in the attached claims is, however, intended to cover all applications and modifications obvious to one skilled in the art. The various uses of the invention include various medical applications in addition to the dental applications already described by way of example above. However, the present embodiment of the rack of the invention offers some major advantages over racks in use today.

I claim:

1. A rack for instruments, especially for dental instruments (1), comprising a drum (2) mounted so as to revolve about a shaft (4), compartments (5) being provided on the periphery of the drum for at least one instrument (1) and its holder (3);

an instrument supply line (6) arranged to be connected to one instrument (1) at a time; and a stationary outer casing (7) surrounding the drum (2) and provided with at least one opening for pulling out at least the instrument connected to the supply line, characterized in that walls (8) separating the compartments (5) of the drum (2) are sealed (9) relative to the outer casing (7); and that the outer casing (7) is provided with means (10, 11, 12) for sterilizing the instruments (1) when they are not being used.

2. A rack according to claim 1, characterized in that the sterilizing means comprise a source (12) of UV light, a source (11) of sterilizing agent, such as gas or liquid, and a vapour sterilizing chamber (10).

3. A rack according to claim 1 or 2, characterized in that the instruments (1) comprise handles (13) identical with each other.

4. A rack according to claim 3, characterized in that the handle (13) is provided with a back valve (40).

* * * * *